US008505911B2

(12) United States Patent
Tamada et al.

(10) Patent No.: US 8,505,911 B2
(45) Date of Patent: Aug. 13, 2013

(54) SHEET DISCHARGING TRAY DEVICE AND IMAGE FORMING SYSTEM PROVIDED THEREWITH

(75) Inventors: Takeshi Tamada, Toyohashi (JP); Eiji Sugimoto, Hino (JP); Kazumichi Yamauchi, Hachioji (JP); Hideo Yamane, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 0 days.

(21) Appl. No.: 13/274,628

(22) Filed: Oct. 17, 2011

(65) Prior Publication Data

US 2012/0104689 A1 May 3, 2012

(30) Foreign Application Priority Data

Nov. 2, 2010 (JP) ..... 2010-246235

(51) Int. Cl.
*B65H 31/04* (2006.01)

(52) U.S. Cl.
USPC ..... 271/213; 271/221

(58) Field of Classification Search
USPC ..... 271/207, 213, 220, 221, 223
See application file for complete search history.

(56) References Cited

U.S. PATENT DOCUMENTS

| | | | | |
|---|---|---|---|---|
| 5,037,081 | A * | 8/1991 | Engelhardt et al. | 271/207 |
| 6,206,365 | B1 * | 3/2001 | Nanba et al. | 271/217 |
| 6,231,039 | B1 * | 5/2001 | Chung | 270/58.01 |
| 6,533,265 | B1 * | 3/2003 | Baldini | 271/207 |
| 6,955,350 | B2 * | 10/2005 | Hashiguchi et al. | 271/255 |
| 7,766,324 | B2 * | 8/2010 | Tamura et al. | 271/213 |
| 2005/0189706 | A1 * | 9/2005 | Tamura et al. | 271/221 |
| 2007/0176357 | A1 * | 8/2007 | Horio et al. | 271/220 |
| 2009/0066003 | A1 * | 3/2009 | Kunieda et al. | 271/3.02 |
| 2010/0270737 | A1 * | 10/2010 | Ichimura | 271/207 |

FOREIGN PATENT DOCUMENTS

JP 2008-189453 A 8/2008

* cited by examiner

*Primary Examiner* — Prasad Gokhale
(74) *Attorney, Agent, or Firm* — Cantor Colburn LLP

(57) ABSTRACT

A sheet discharging tray device includes: a discharging section from which a sheet is discharged; a discharging tray on which the sheet discharged from the discharging section is stacked sequentially; a tray drive section which drives the discharging tray in a tray shift direction that is perpendicular to a sheet discharging direction from the discharging section with reference to a sheet surface; a controller which conducts a tray shift operation that shifts a position of the discharging tray under a condition of the number of sheets stacked on the discharging tray, and a sheet detection section which detects an alignment deviation in the tray shift direction. The controller changes an operation status of the discharging tray when a tray shift operation is conducted and changes a discharging operation of a sheet to the discharging tray, based on a detected result of the sheet detection section.

17 Claims, 9 Drawing Sheets

FIG. 5

| LIMIT VALUE OF ALIGNMENT DEVIATION | SENSOR POSITION |
|---|---|
| 1 mm | OUTWARD BY 0.5 mm |
| 2 mm | OUTWARD BY 1.0 mm |
| 3 mm | OUTWARD BY 2.0 mm |
| 4 mm | OUTWARD BY 3.0 mm |
| NOT REQUIRED | NOT DETECTED |

FIG. 6

| POSITION OF SHEET DETECTION SENSOR | NUMBER OF TRAY SHIFT OPERATIONS | LEVEL OF ALIGNMENT DEVIATION |
|---|---|---|
| 1 mm | 1-5 | A |
| 1 mm | 6- | B |
| 2 mm | 1-10 | A |
| 2 mm | 11- | B |
| 3 mm | 1-15 | A |
| 3 mm | 16- | B |
| 4 mm | 1-20 | A |
| 4 mm | 21- | B |

FIG. 7

| LEVEL OF ALIGNMENT DEVIATION | MOVING AMOUNT OF SENSOR | CHANGE AMOUNT OF SHEET LINE SPEED | CHANGE AMOUNT OF TRAY SHIFT SPEED |
|---|---|---|---|
| DEFAULT | | 1000 mm/s | 150 mm/s |
| A | OUTWARD BY 0.5 mm | -100 mm/s | -30 mm/s |
| B | OUTWARD BY 0.3 mm | -50 mm/s | -15 mm/s |

FIG. 8

| LEVEL OF ALIGNMENT DEVIATION | AMOUNT OF TRAY SHIFT |
|---|---|
| DEFAULT | 15 mm |
| B | 12 mm |
| A | 9 mm |

FIG. 10

| LEVEL OF ALIGNMENT DEVIATION | MOVING AMOUNT OF SENSOR | CHANGE AMOUNT OF PPM | CHANGE AMOUNT OF TRAY SHIFT SPEED |
|---|---|---|---|
| DEFAULT | | 120 ppm | 150 mm/s |
| A | OUTWARD BY 0.5 mm | 114 ppm | -30 mm/s |
| B | OUTWARD BY 0.3 mm | 108 ppm | -15 mm/s |

SHEET DISCHARGING TRAY DEVICE AND IMAGE FORMING SYSTEM PROVIDED THEREWITH

This application is based on Japanese Patent Application No. 2010-246235 filed on Nov. 2, 2010, which is incorporated hereinto by reference.

BACKGROUND OF THE INVENTION

The present invention relates to a sheet discharging tray device and an image forming system provided with the sheet discharging tray device.

What is commonly known in the prior art includes an image forming system. This image forming system is provided with an image forming apparatus using the electrophotographic process, and includes a sheet finisher for performing various forms of sheet finishing operations as required, and an intermediate conveyance device for conveyance of sheets between the image forming apparatus and sheet finisher.

The image forming system of this type includes a sheet discharging tray device equipped with a sheet discharging tray for loading sheets discharged from the sheet discharging section on the final stage of the system. To discharge a great number of sheets, this sheet discharging tray device is designed in such a way that the sheet discharging tray moves vertically in the sheet loading direction. To offset the sheet loading position for a prescribed number of sheets, the sheet discharging tray is swingably structured in the direction of tray shift.

For example, the Japanese Patent Application Publication No. 2008-189453 discloses a sheet discharging tray device wherein a plurality of sheets are conveyed at a prescribed speed at prescribed intervals and are discharged from a discharge outlet, and the sheets stacking on the sheet discharging tray are placed on a sheet discharging tray. This sheet discharging tray device performs tray shift operation wherein the sheet discharging tray is moved in the horizontal direction approximately perpendicular to the sheet discharge direction. This is to ensure that, after the continuously conveyed preceding sheets have been placed on the sheet discharging tray, the succeeding sheets conveyed after the preceding sheets will be placed at a position offset with respect to the position of the preceding sheets loaded on the sheet discharging tray. Here the tray shift operation is performed wherein the speed of the sheet discharging tray is reduced just before the completion of sheet discharging tray movement.

The sheet discharging tray device of this type has a problem in that a sheet alignment deviation is likely to occur due to the tray shift operation. Further, to ensure alignment performance, it is necessary to reduce the movement of the tray shift operation and to set an increased sheet distance between discharged sheets for the sheet tray. However, this may result in reduced productivity.

In view of the problems described above, it is an object of the present invention to perform tray shift operation by ensuring desired alignment performances and the maximum productivity.

SUMMARY OF THE INVENTION

1. To achieve at least one of the abovementioned objects, a sheet discharging tray device reflecting one aspect of the present invention, has: a sheet discharging tray for stacking sheets wherein sheets discharged from a sheet discharging section are sequentially loaded; a tray drive section for moving the sheet discharging tray in the tray shift direction perpendicular to the direction of discharging sheets from the sheet discharge section with reference to the sheet surface; a controller for tray shift operation wherein the sheet discharging tray position is shifted on condition of the number of sheets loaded on the sheet discharging tray by controlling the tray drive section; a sheet detection section for detecting the sheet alignment deviation in the tray shift direction; wherein the controller changes the operation status of the sheet discharging tray at the time of the tray shift operation based on the result of detection by the sheet detection section, and the status of the sheets discharged to the sheet discharging tray.

2. In the sheet discharging tray device of the aforementioned Item 1, the aforementioned controller preferably changes operation status of the sheet discharging tray so that the movement of the sheet discharging tray will be reduced when sheet alignment deviation has been detected by the sheet detection section, and changes the sheet discharge status of the sheet so that the distance between adjoining discharged sheets to be discharged into the sheet discharging tray is increased.

3. In the sheet discharging tray device of the aforementioned Item 2, the aforementioned controller preferably makes a stepwise evaluation of the size of the alignment deviation of this sheet with reference to the limit value of the alignment deviation which is permitted by a user, performs a stepwise modification of the operation status of the sheet discharging tray according to these evaluation steps, and implements a stepwise change of the sheet discharge status of the sheet.

4. In the sheet discharging tray device of the aforementioned Item 3, the controller preferably suspends the device operation when a sheet alignment deviation in excess of the aforementioned limit value has been detected.

5. In the sheet discharging tray device of the aforementioned Item 4, the controller preferably allows the user to determine whether the device operation should be suspended or not, when a sheet alignment deviation in excess of the aforementioned limit value has been detected.

6. In the sheet discharging tray device of any one of the aforementioned Items 2 through 5, the controller preferably changes the operation status of the sheet discharging tray by reducing either the moving amount of the sheet discharging tray or the moving speed of the sheet discharging tray.

7. In the sheet discharging tray device of any one of the aforementioned Items 2 through 6, a further conveyance path for conveying sheets is provided to convey sheets to this sheet discharging section including the sheet discharging section. In this case, the controller preferably changes the discharge status of the aforementioned sheets by using at least one of the following methods: a method of reducing the linear speed of the sheets along the conveyance path; a method of reducing the distance between adjoining sheets, with the sheet linear speed along the conveyance path being kept unchanged; and a method wherein a preceding sheet is temporarily retained in the sheet conveyance path leading to the sheet discharging section, and a succeeding sheet is then placed on top of the preceding sheet, this step being followed by a step of conveying the sheet again.

8. In the sheet discharging tray device of any one of the aforementioned Items 1 through 7, the controller preferably provides control in such a way that the alignment deviation of sheets detected by the sheet detection section is stored as data, and the operation status of the sheet discharging tray is changed in advance when printing conditions are again used for the same printing job.

9. In the sheet discharging tray device of any one of the aforementioned Items 1 through 7, the aforementioned sheet detection section is a transmission type sensor composed of light emitting elements located apart from each other in the direction of stacked sheets, and the controller preferably changes the position in the aforementioned tray shift direction in conformity to the sheet alignment performance.

10. In the sheet discharging fray device of any one of the aforementioned Items 1 through 8, the sheet detection section is preferably a linear image sensor structured by a plurality of light receiving elements arranged linearly in the tray shift direction.

11. An image forming system including: the aforementioned sheet discharging tray device described in any one of the aforementioned 1 through 10; and an image forming apparatus including the sheet discharging section for discharging sheets to the sheet discharging tray device, wherein the image forming apparatus forms an image on the sheets.

12. An image forming system including: the aforementioned sheet discharging tray device described in any one of the aforementioned Items 1 through 10; an image forming apparatus for forming an image of the sheet; and a sheet finisher containing a sheet discharging section for discharging sheets to the sheet discharging tray device, wherein the sheet finisher serves to finish the sheet having an image formed thereon by the image forming apparatus.

13. The image forming system described in the aforementioned Item 12, further including an intermediate conveyance device provided with a superimposing section, wherein a plurality of sheets conveyed from the image forming apparatus are placed one on top of another and are conveyed to the sheet finisher.

BRIEF DESCRIPTION OF THE DRAWINGS

FIG. 5 is an explanatory diagram showing the correspondence between the alignment deviation limit value and sensor position.

FIG. 6 is an explanatory diagram showing the Table for calculating the alignment deviation level.

FIG. 7 is an explanatory diagram showing the Table for illustrating the correspondence among alignment deviation level, sensor moving amount, linear speed change amount and tray shift speed change amount.

FIG. 8 is an explanatory diagram showing the Table for showing the correspondence between alignment deviation level and tray shift amount.

FIG. 10 is an explanatory diagram showing the Table for illustrating the correspondence among alignment deviation level, sensor moving amount, PPM change amount and tray shift speed change mount.

DETAILED DESCRIPTION OF THE PREFERRED EMBODIMENT

Embodiment 1

Figure 1:
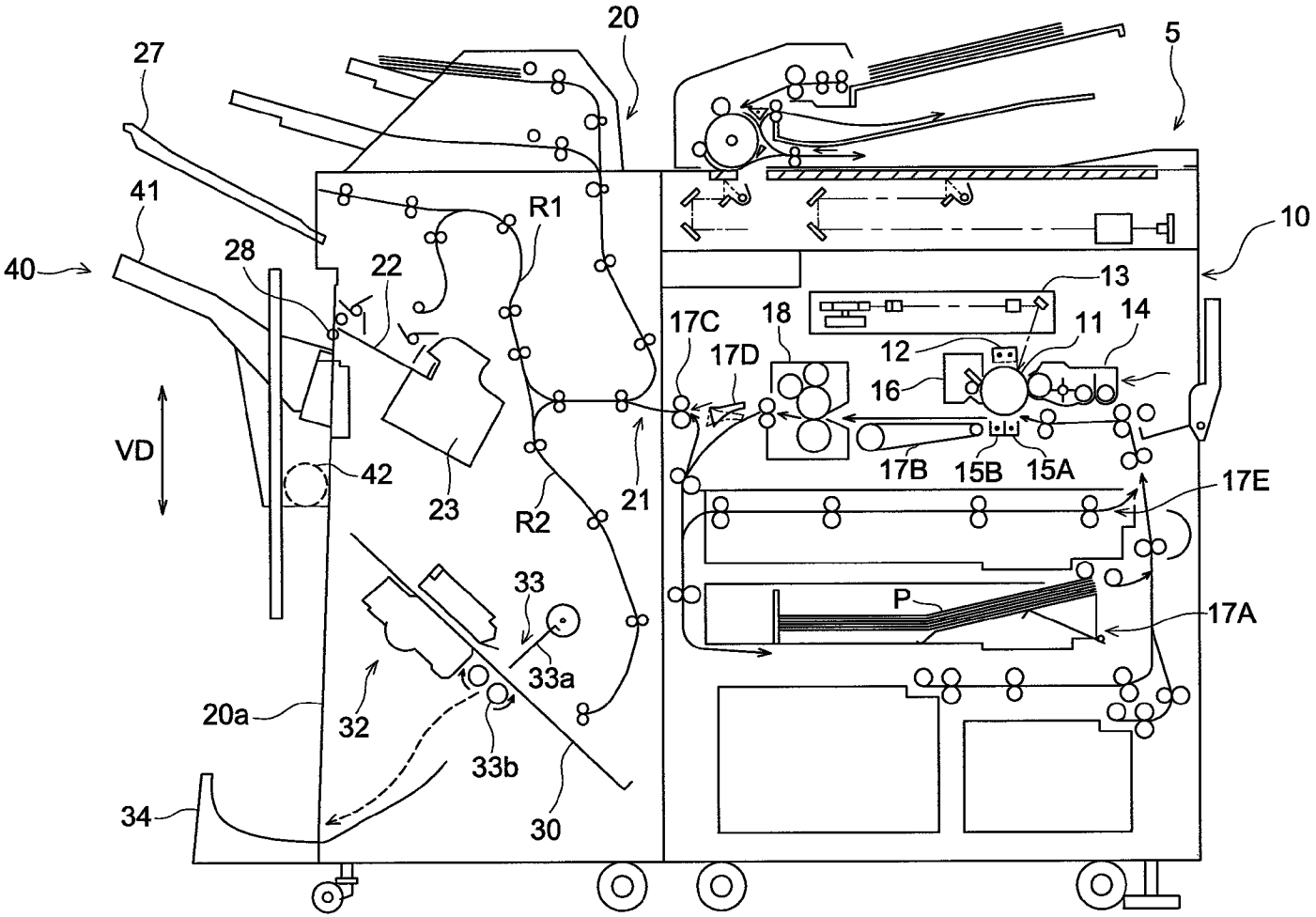
FIG. 1 is a schematic diagram representing the entire structure of an image forming system to which the sheet discharging tray device 40 of a first embodiment is applied.

FIG. 1 is a schematic diagram representing the entire structure of an image forming system to which the sheet discharging tray device 40 of a first embodiment of the present invention is applied. The image forming system of the first embodiment is a copying machine having an image forming apparatus 10 and sheet finisher 20.

The image forming apparatus 10 forms an image on the sheet P based on the output image data. The image forming apparatus 10 includes a document reading device 5, photoreceptor 11, charging section 12, image exposing section 13, developing section 14, transferring section 15, separation section 15B, cleaning device 16 and, fixing device 18.

The document reading device 5 is placed on the upper portion of the image forming apparatus 10, and is provided with an automatic document feeding section that reads an image by moving the document. This document reading device 5 reads an image formed on the document and outputs a prescribed image signal. The image signal having been inputted is subjected to analog-to-digital conversion, whereby input image data is created.

The image reading controller (not illustrated) provided on the document reading device 5 applies such processing as shading correction, dither processing or compression to the input image data. The data obtained from this processing is stored as output image data in the RAM of the image forming controller 50 (refer to FIG. 3). The output image data can be the data received from the personal computer connected to the image forming apparatus 1 or other image forming apparatuses, as well as the data outputted from the document reading device 5.

The surface of the photoreceptor 11 is uniformly charged by a charging diction 12. The image exposing section 13 uses a laser beam to scan and expose the surface of the photoreceptor 11 based on the output image data, in response to the output information outputted from the image forming controller 50. This procedure forms a latent image on the surface of the uniformly charged photoreceptor 11. The developing section 14 uses toner to provide reversal development of the latent image, whereby a toner image is formed on the surface of the photoreceptor 11.

The sheet P accommodated in the sheet storing section 17A is fed to the transferring section 15. The transferring section 15A transfers the toner image on the surface of the photoreceptor 11 to the sheet P. After that, the sheet P with a toner image transferred thereon is separated from the photoreceptor 11 by the separation section 15B. The intermediate conveying section 17B conveys the separated sheet P to the fixing device 18. The fixing device 18 fixes an image on the sheet P in position by applying heat and pressure. The sheet P provided with a process of fixing is discharged to the sheet finisher 20 by the sheet discharging section 17C. In the meantime, the cleaning device 16 removes the remaining toner from the surface of the photoreceptor 11 after the toner image has been transferred to the sheet P by the transferring section 15A.

When an image is formed on both surfaces of a sheet P, the sheet P provided with a process of fixing by the fixing device 18 is switched by the conveyance path switching plate 17D over to the reverse conveyance section 17E wherein the direction of conveyance is different from that on the side of the sheet discharging section 17C. After having switched back the sheet P to reverse the sheet P, the reverse conveyance section 17E sends the sheet P to the transferring section 15A.

The transferring section 15A forms a toner image on the reverse side of the sheet P. The sheet P with an image formed thereon is fed through the fixing device 18 and is discharged to the sheet finisher 20 from the sheet discharging section 17C.

The sheet finisher 20 applies various forms of finishing process to the sheet P discharged from the image forming apparatus 10. The finishing operations performed by the sheet finisher 20 include an end stitching operation wherein a prescribed number of sheets P are stacked, and stapling is provided at the position close to the end, and a booklet creating operation wherein a prescribed number of sheets P are stacked, and center folding or center stitching is provided. Center folding is a step of applying a center-folding process to a bundle of sheets. Center stitching is a step of applying a center-folding and center-stitching process to the bundle of sheets. The sheet P discharged from the image forming apparatus 10 can be discharged without any process being applied by the sheet finisher 20.

Figure 3:
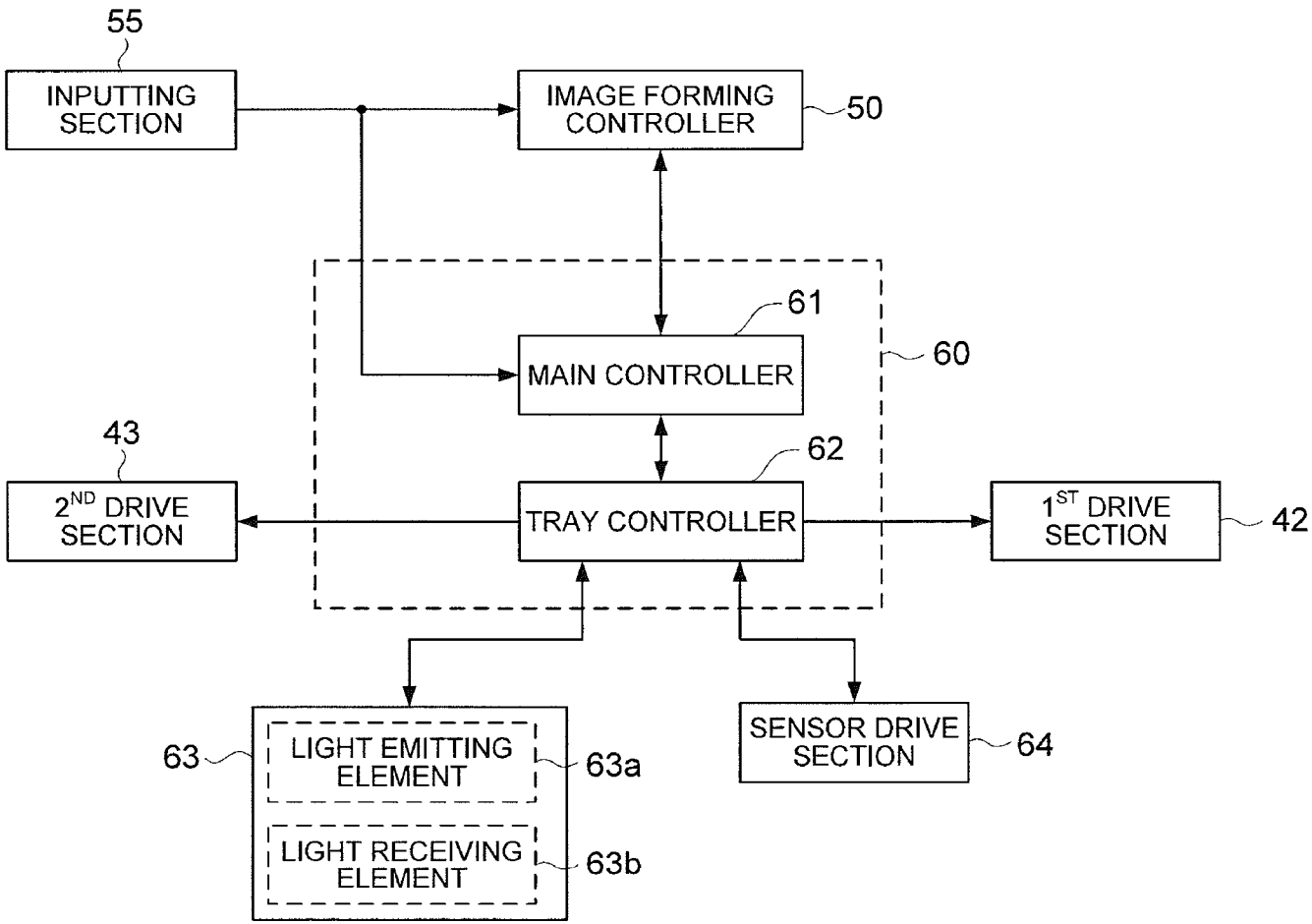
FIG. 3 is a block diagram schematically showing the control system of the image forming system.

The major components of the sheet finisher 20 include an introduction section 21, the first intermediate stacker 22, end stitching stapler 23, the second intermediate stacker 30, center stitching stapler 32, center folding section 33, sheet discharging roller 28 as a sheet discharging section, sheet discharging tray device 40 and sheet finisher controller 60 (refer to FIG. 3). These components of the sheet finisher 20 are mainly accommodated in the enclosure 20*a*.

The introduction section 21 introduces the sheets P discharged from the image forming apparatus 10 into the sheet finisher 20. The introduction section 21 is positioned in such a way as to be matched with the sheet discharging section 17C with the image forming apparatus 10.

The conveyance path downstream of the introduction section 21 is divided into the first conveyance path R1 and second conveyance path R2. The sheets P introduced from the introduction section 21 in response to the switching operation of the switching gate (not illustrated) are supplied to either the first conveyance path R1 or the second conveyance path R2. The first conveyance path R1 and the second conveyance path R2 each are structured by multiple conveyance rollers and guide members.

The first conveyance path R1 conveys the sheet P introduced from the introduction section 21 to the upper sheet discharging tray 27 or the first intermediate stacker 22 in response to the switching operation of the switching gate (not illustrated) provided in the middle portion of the conveyance path R1.

The upper sheet discharging tray 27 is fastened to the upper level outside the enclosure 20*a*. Since the upper sheet discharging tray 27 has a smaller loading capacity of the sheets P, this tray is frequently used to discharge a smaller number of sheets, particularly such special sheets P as thick paper.

The sheets P discharged to the first intermediate stacker 22 are discharged to the middle sheet discharging tray 41 (sheet discharging tray device 40 to be described later) according to the following two patterns.

The first pattern refers to the case wherein a great number of sheets P such as plain paper are discharged without being subjected to any processing. In this case, the sheets P discharged from the first intermediate stacker 22 are pushed toward the sheet discharging roller 28 by the extrusion member (not illustrated). After that, the sheets P are discharged to the middle sheet discharging trays 41 by the sheet discharging roller 28. This sheet discharging operation is performed every time sheets P are discharged to the first intermediate stacker 22.

The second pattern applies to the case wherein end stitching is performed. In this case, sheets P discharged to the first intermediate stacker 22 are sequentially stacked to the first intermediate stacker 22, and a bundle of stacked sheets are subjected to end stitching by the end stitching stapler 23. This end stitching stapler 23 is arranged on the rear end of the first intermediate stacker 22. Stapling is applied in a prescribed direction to a prescribed position in the vicinity of the end of the bundle of sheets placed on the first intermediate stacker 22. The bundle of sheets whose ends are bound by the end stitching stapler 23 is pushed toward the sheet discharging roller 28 by an extrusion member (not illustrated). After that, these sheets are discharged to the middle sheet discharging tray 41 by the sheet discharging roller 28.

The sheets P introduced from the introduction section 21 are conveyed to the second intermediate stacker 30 by the second conveyance path R2. One or more of the sheets P discharged to the second intermediate stacker 30 are stacked on the second intermediate stacker 30. A bundle of stacked sheets are subjected to prescribed processing by the center stitching stapler 32 or center folding section 33, and are formed into a booklet. This booklet is discharged to the lower sheet discharging tray 34. The lower sheet discharging tray 34 is fastened to the lower position outside the enclosure 20*a*.

The center stitching stapler 32 staples the bundle of sheets stacked on the second intermediate stacker 30. Center stitching is provided by this procedure. The center folding section 33 is structured by a folding plate 33*a* and a pair of folding rollers 33*b* that are arranged opposed to each other through a second intermediate stacker 30. This center folding section 33 advances the folding plate 33*a* to the side of a pair of folding rollers 33*b*, whereby the process of center folding is applied to the bundle of sheets stacked on the second intermediate stacker 30 or the bundle of sheets provided with center stitching by the center stitching stapler 32.

To enable a great number of sheets to be discharged, the sheet discharging tray device 40 is designed to move vertically in the direction of loading sheets P (hereinafter referred to as "sheet loading (or stacking) direction"). This sheet discharging tray device 40 is loaded with the sheets P discharged from the sheet discharging roller 28 through the first intermediate stacker 22.

Figure 2A:
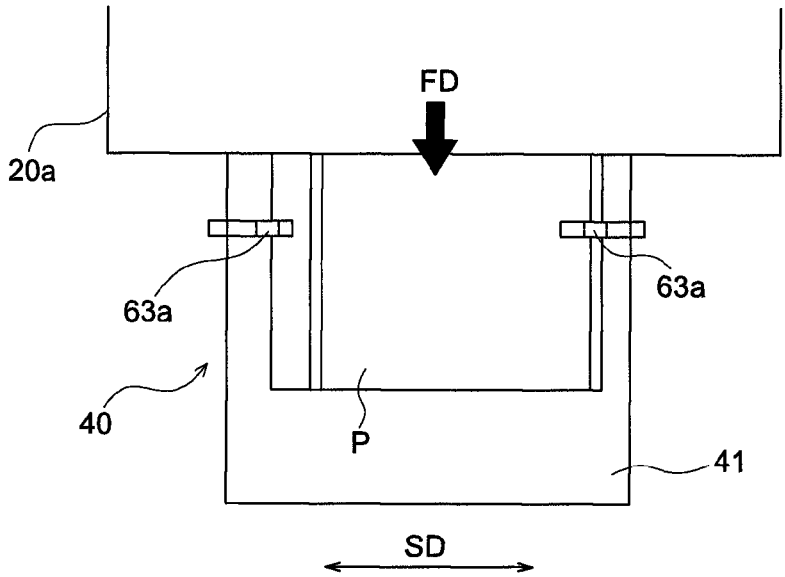
FIGS. 2A-2B are explanatory diagrams schematically showing the structure of the sheet discharging tray device 40.
Figure 2B:
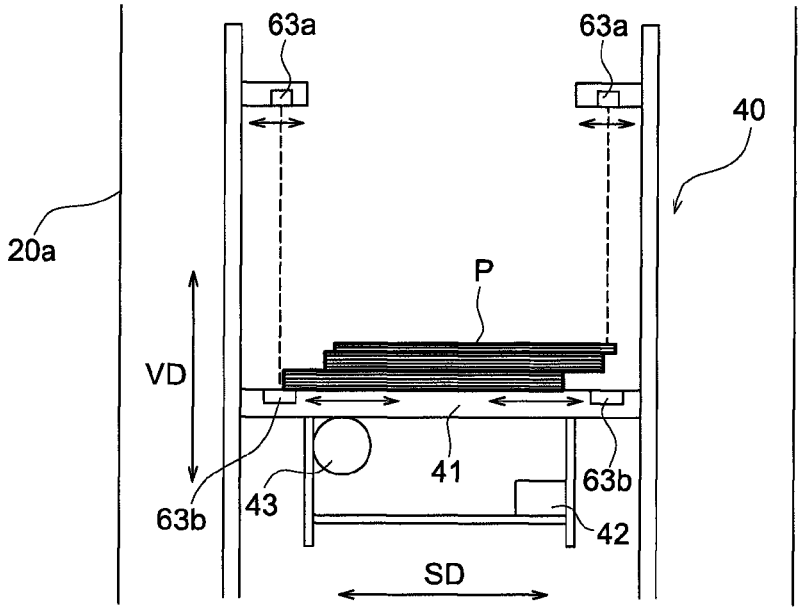

As shown in FIG. 1 and FIGS. 2A-2B, the sheet discharging tray device 40 includes a middle sheet discharging tray 41 and a pair of tray drive sections 42 and 43 as major components. FIGS. 2A-2B are explanatory diagrams schematically showing the structure of the sheet discharging tray device 40. The FIG. 2A is a top view and FIG. 2B is a front view.

The middle sheet discharging tray 41 is arranged in the middle position outside the enclosure 20*a*. The middle sheet discharging tray 41 is loaded with the sheets sequentially discharged from the sheet discharging roller 28 as a sheet discharging section for discharging sheets P.

The first drive section 42 includes, for example, an electric motor and a power transmission mechanism for transmitting power from the electric motor. This first drive section 42 drives the electric motor to move the middle sheet discharging tray 41 in the sheet stacking direction VD. The moving amount and speed of the middle sheet discharging tray 41 moved by the first drive section 42 are controlled by the sheet finisher controller 60.

The second tray drive section 43 includes, for example, an electric motor and a power transmission mechanism for transmitting power from the electric motor. This second drive section 43 drives the electric motor to move the middle sheet discharging tray 41 in the direction SD (hereinafter referred to as "tray shift direction") perpendicular to the sheet discharge direction FD wherein the sheet is fed from the sheet discharging roller 28, with reference to the sheet surface. The moving amount and speed of the middle sheet discharging tray 41 moved by the second drive section 43 are controlled by the sheet finisher controller 60.

FIG. 3 is a block diagram schematically showing the control system of the image forming system of the present embodiment. The control system of the image forming system includes an image forming controller 50 for integral control of the image forming apparatus 10 and sheet finisher controller 60 for controlling the sheet finisher 20, as major components.

The image forming controller 50 is allowed to use, for example, a micro computer including a CPU, ROM, RAM and I/O interface and major components. The image forming controller 50 performs various forms of calculation in conformity to the control program stored in the ROM and controls the operation status of the image forming apparatus 10 based on the result of calculation.

The image forming controller 50 controls each part of the image forming apparatus 1 to execute a series of processing shown below. This procedure allows the toner image to be formed on the sheet P.

(1) Charging of photoreceptor 11;

(2) Forming an electrostatic latent image on the photoreceptor 11 by the image exposing section 13;

(3) Applying toner to the electrostatic latent image having been formed;

(4) Transfer of the toner image on the photoreceptor 11 to the sheet P;

(5) Conveyance of sheet P; and (6) Fixing the toner image on the sheet P.

Printing conditions are inputted into this image forming controller 50 based on the information set through the inputting section 55 installed on the upper portion of the main body of the image forming apparatus 10, or the information received together with the output image data from a personal computer or another image forming apparatus. These printing conditions include the type of printing (simplex or duplex printing), sheet information (e.g., size, type (thin paper, plain paper or thick paper) and basis weight), image density, magnification rate, and the number of copies to be printed. The inputting section 55 is allowed to use a touch panel that can be employed to input data, for example, according to the information shown in the display. Further, the information on printing conditions is also sent to the sheet finisher controller 60.

The sheet furnisher controller 60 is allowed to use, for example, a micro computer including a CPU, ROM, RAM and I/O interface as major components. The image forming controller 60 performs various forms of calculation in conformity to the control program stored in the ROM and controls the operation status of the sheet finisher 20 based on the result of the calculation.

This sheet finisher controller 60 stores various forms of information including that from the sheet detection section sheet detector 63. The sheet detection sensor 63 is a transmission type sensor composed of a light emitting element 63*a* and light receiving element 63*b*, and detects the presence or absence of a sheet Pin conformity to the presence or absence of the detection light from the light emitting element 63*a* detected by the light receiving element 63*b*. As shown in FIGS. 2A-2B, two sheet detection sensors 63 are placed a prescribed distance apart from each other in the tray shift direction SD in such a way as to sandwich the center of the sheets P stacked on the middle sheet discharging tray 41.

The light emitting element 63*a* is installed above the middle sheet discharging tray 41 through the support member provided on the lateral end of the middle sheet discharging tray 41. The light emitting element 63*a* is driven by the sensor drive section 64 (refer to FIG. 3) to be described later, and is moved in the sheet stacking direction VD. Further, the light emitting element 63*a* is driven by the sensor drive section 64 and is moved in the tray shift direction SD.

The light receiving element 63*b* is arranged on the sheet stacking surface of the middle sheet discharging tray 41 so that the light receiving element 63*b* is positioned immediately below the light emitting element 63*a* in the sheet stacking direction VD. This light receiving element 63*b* is driven by the sensor drive section 64, and is moved in the tray shift direction SD. The movement of this light receiving element 63*b* in the tray shift direction SD is synchronized with the position of the light emitting element 63*a* in the tray shift direction SD.

The sheet finisher controller 60 includes a main controller 61 and tray controller 62, as observed from the functional viewpoint.

The main controller 61 has a function of overall control of the sheet finisher 20. For example, the main controller 61 controls the conveyance of sheets P inside the device, and discharge of sheets P to the sheet discharging trays 27, 41 and 34. Further, the main controller 61 controls the first intermediate stacker 22, end stitching stapler 23, the second intermediate stacker 24, center stitching stapler 25 or center folding section 26, with the progress in the operation of end stitching or booklet creation.

The tray controller 62 has a function of controlling the sheet discharging tray device 40. In the present embodiment, the tray controller 62 performs the following functions.

The first function of the tray controller 62 is to control the first drive section 42, thereby controlling the position of the middle sheet discharging tray 41 (the position in the sheet stacking direction VD). To put it more specifically, when the sheets P are loaded on the middle sheet discharging tray 41, the tray controller 62 moves the middle sheet discharging tray 41 in response to the number of the loaded sheets P to ensure that the topmost surface of the sheets P mounted on the middle sheet discharging tray 41 does not exceed the upper limit position determined in advance. The topmost surfaces of the sheets P loaded on the middle sheet discharging tray 41 can be detected directly using a sensor. These surfaces can also be detected indirectly by calculation based on the number of sheets P to be discharged and the type of these sheets.

The second function of the tray controller 62 is to control the second drive section 43, thereby controlling the position of the middle sheet discharging tray 41 (position in the tray shift direction SD). This allows the tray controller 62 to perform the tray shift operation of shifting the middle sheet discharging tray 41 in the tray shift direction SD. To put it more specifically, the tray controller 62 performs tray shift operations, based on the number of sheets P, for example, ten sheets, loaded on the middle sheet discharging tray 41. The tray shift operation can be performed in various patterns. In the present embodiment, the middle sheet discharging tray 41 is alternately shifted between the tray shift direction SD and the direction perpendicular thereto. In the middle sheet discharging tray 41, sheets P are loaded in positions offset for each ten sheets, for example, through this tray shift operation.

The third function of the tray controller 62 is to control the sensor drive section 64, thereby controlling the position of the light emitting element 63*a* constituting the sheet detection sensor 63 in the sheet stacking direction VD. When sheets P are loaded on the middle sheet discharging tray 41, this function is executed in response to the number of the loaded sheets P to ensure that the topmost surfaces of the sheets P loaded on the middle sheet discharging tray 41 are apart from the light emitting element 63*a* by a prescribed distance (distance in the sheet stacking direction VD).

Further, the tray controller 62 controls the sensor drive section 64, thereby controlling the position of the light emitting element 63*a* and light receiving element 63*b* constituting the sheet detection sensor 63 in the tray shift direction SD. The positions of the light emitting element 63*a* and light receiving element 63*b* as a set constituting the sheet detection sensor 63 are controlled in the tray shift direction SD in a mutually synchronized status.

The fourth function of the tray controller 62 is to acquire information required for control, according to the printing conditions obtained by the inputting section 55 or others. The acquired information includes an alignment deviation limit value and operation mode.

Here the alignment deviation is defined as misalignment of the sheet end in the tray shift direction SD for a bundle of sheets loaded in mutually corresponding positions, namely, for a bundle of sheets which are loaded in one and the same position from the time when the middle sheet discharging tray 41 is shifted, to the time when the next shift takes place. The alignment deviation is caused by the inertia that occurs to the sheets P at the time of tray shift operation. The sheets P loaded on the middle sheet discharging tray 41 are misaligned from a prescribed offset position in the tray shift direction SD. The alignment deviation limit value can be defined as a value representing the limit authorized by the user when sheets P are loaded. For example, the tray controller 62 displays such arbitrary values as 1 mm, 2 mm, 3 mm and 4 mm. When a prescribed value is selected through the inputting section 55, the alignment deviation limit value is acquired. Depending on the type of the printing job, no problem arises even if an alignment deviation has occurred. Accordingly, the tray controller 62 is capable of displaying the "Unspecified" item that does not designate any specific value.

The operation mode defines the operation of the sheet discharging tray device 40 when an alignment deviation greater than the alignment deviation limit value has been detected. This operation mode includes an alignment performance priority mode and productivity priority mode. The alignment performance priority mode is the mode wherein priority is placed on alignment performance. If this mode has been selected, the tray controller 62 suspends the printing operation to stop discharge of sheets P to the middle sheet discharging tray 41. In the meantime, the productivity priority mode is the mode wherein priority is placed on productivity rather than on alignment performance. If this mode has been selected, the tray controller 62 continues the printing operation so that discharge of sheets P to the middle sheet discharging tray 41 continues.

Figure 4:
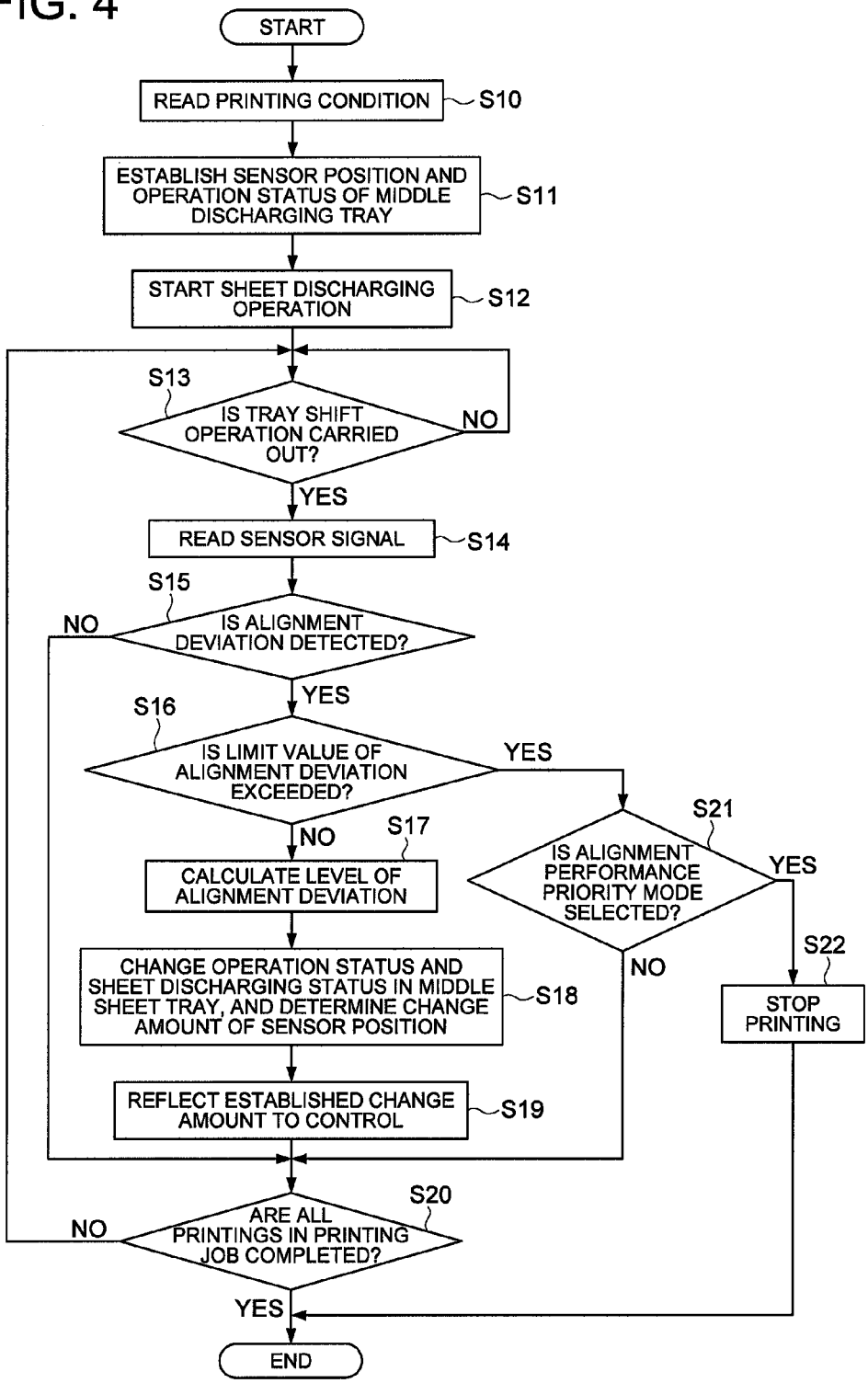
FIG. 4 is a flow chart showing the operation of the sheet discharging tray device 40.

FIG. 4 is a flow chart showing the operation of the sheet discharging tray device 40 in the present embodiment. Processing of this flow chart is executed by the tray controller 62 as triggered by the printing start command given by the user.

In the first place, in Step 10 (S10), the tray controller 62 reads the printing conditions. To put it more specifically, the tray controller 62 reads the limit value of alignment deviation and the operation mode.

In Step 11 (S11), the tray controller 62 sets up the sensor position that defines the position of the sheet detection sensor 63 in the tray shift direction SD and the operation status of the middle sheet discharging tray 41.

The sensor position is set by referring to the Table (refer to FIG. 5) showing he correspondence between the prepared alignment deviation limit value and the sensor position, based on the alignment deviation limit value. As shown in FIGS. 2A and 2B, the sensor position is defined as the position of the sheets P going outward in the tray shift direction SD wherein the sheets P are loaded at the offset positions in the middle sheet discharging tray 41 and the lateral end in the aforementioned tray shift direction SD is used as a starting point. The sensor position is set at the position further away outward from the lateral end of the sheet P, as the alignment deviation limit value is greater.

The operation status of the middle sheet discharging tray 41 includes the moving speed of the middle sheet discharging tray 41 (hereinafter referred to as "tray shift speed") at the time of tray shift operation and the moving amount thereof (hereinafter referred to as "tray shift amount"). In this Step, both values are set. Default values are preset as the tray shift speed and tray shift amount In Step 11, the default values are set as the tray shift speed and tray shift amount. The default value for tray shift speed is 150 mm/s, for example. The default value for tray shift amount is 15 mm, for example.

In Step 12 (S12), the tray controller 62 starts the operation of discharging sheets P. With the start of the discharging operation, the tray controller 62 moves the sheet detection sensor 63 to the preset sensor position. If discharge of sheets P from the sheet discharging roller 28 to the middle sheet discharging tray 41 has started, the tray controller 62 executes the following control on a continuous basis. The tray controller 62 controls the position of the middle sheet discharging tray 41 in the sheet stacking direction VD in conformity to the position of the topmost surfaces of the sheets P loaded on the middle sheet discharging tray 41. Further, the tray controller 62 performs tray shift operations, depending on the number of the sheets P loaded on the middle sheet discharging tray 41. Examples are the user designated value, the number of documents as a printing source when sorted output is to be performed, and the number of prints when there is no sorted output The tray shift operation is performed in conformity to the preset operation status, i.e., the tray shift speed and tray shift amount.

In Step 13 (S13), the tray controller 62 determines whether or not tray shift operation has been made, i.e., whether or not the middle sheet discharging tray 41 has moved to the tray shift direction SD. If the decision in this Step is affirmative, namely, if the tray shift operation has been performed, the operation goes to Step S14 (S14). If the decision is negative, namely, if the tray shift operation has not yet been performed, the decision of Step 13 (S13) is made again.

In Step 14, the tray controller 62 reads the sensor signal from the sheet detection sensor 63.

In Step 15 (S15), the tray controller 62 determines if the alignment deviation has been detected or not. To put it more specifically, the tray controller 62 determines whether or not the sheet detection sensor 63 has detected sheets P. If the decision in Step 15 is affirmative, namely, if the alignment deviation has been detected, the operation goes to Step 16 (S16). If the decision in Step 15 is negative, namely, if the alignment deviation has not yet been detected, the operation goes to Step 20 (S20) to be described later. If "Unspecified" is set as an alignment deviation limit value, the decision in Step 15 is considered as negative.

In Step 16, the tray controller 62 determines if the detected alignment deviation has exceeded the alignment deviation limit value or not. As will be described later, when the alignment deviation has been detected, the sheet detection sensor 63 is moved further outward from the current position as a reference. This movement is performed until the position of the sheet detection sensor 63 reaches the alignment deviation limit value. Thus, in this Step, the alignment deviation is assumed as having exceeded the alignment deviation limit value if the sheet detection sensor 63 has reached the position corresponding to the alignment deviation limit value and the sheet detection sensor 63 has detected the sheet P.

If the decision in Step 16 is negative, namely, if the alignment deviation has not exceeded the alignment deviation limit value, the operation goes to Step 17 (S17). If the decision in Step 16 is affirmative, namely, if the alignment deviation has exceeded the alignment deviation limit value, the operation goes to Step 21 (S21).

In Step 17, the tray controller 62 calculates the alignment deviation level as an indicator showing the size of the alignment deviation of the sheet P. Referring to the Table of FIG. 6, the tray controller 62 calculates the alignment deviation level based on the position of the sheet detection sensor 63 and the number of tray shift operations. In the present embodiment, the alignment deviation level to be calculated is either "level A" showing that the alignment deviation is greater, or "level B" showing that the level is smaller than level A, namely, that the alignment deviation level is smaller than level A. In the Table of FIG. 6, the sheet detection sensor 63 is located outward from the lateral ends of the loaded sheets P. The number of tray shift operations is defined as the number of tray shift operations performed since the start of discharging the sheets P to the middle sheet discharging tray 41.

In Step 18 (S18), the tray controller 62 determines the operation status of the middle sheet discharging tray 41 and the change amount of the sheet discharge status. To put it more specifically, the tray controller 62 changes the operation status of the middle sheet discharging tray 41 to ensure that the movement of the middle sheet discharging tray 41 will be reduced as the alignment deviation has been detected. Further, the tray controller 62 changes the sheet discharge status of the sheets to increase the distance between discharged sheets P discharged to the middle sheet discharging tray 41. The change amount is determined in such a way that the change amount in each status will be increased, as the alignment deviation level detected in Step 17 is increased.

In the present embodiment, the parameter to be changed as the operation status of the middle sheet discharging tray 41 is the tray shift speed. To be more specific, in Step 18, the change amount is determined so that the tray shift speed will be decreased. As shown in FIG. 7, the tray controller 62 includes the Table showing the correspondence between the alignment deviation level and the change amount of tray shift speed. Referring to this Table, the tray controller 62 determines the change amount of the fray shift speed based on the alignment deviation level.

The parameter to be changed as the sheet discharge status for sheets P represents the linear speed of sheets P. To put it another way, in Step 18, the change amount is determined so that the linear speed of sheets P will be reduced. As shown in FIG. 7, the tray controller 62 includes the Table showing the correspondence between the alignment deviation level and the change amount of linear speed. Referring to this Table, the tray controller 62 determines the change amount of the linear speed based on the alignment deviation level.

Further, in Step 18, the tray controller 62 determines the change amount of the sensor position. To put it more specifically, the tray controller 62 changes the sensor position so that the sheet detection sensor 63 will be located further outward from the current position in the tray shift direction SD. The change amount is determined in such a way that the change amount of the sensor position will be increased, as the alignment deviation level detected in Step 17 is increased. As shown in FIG. 7, the tray controller 62 includes the Table showing the correspondence between the alignment deviation level and the change amount of sensor position. Referring to this Table, the tray controller 62 determines the change amount of sensor position based on the alignment deviation level.

In Step 19 (S19), the tray controller 62 allows the set change amount to be reflected in the control. To put it more specifically, the tray controller 62 determines a new tray shift speed by giving consideration to the change amount in the current tray shift speed. After that, tray shift operation is performed in conformity to the tray shift speed having been determined. Further, the tray controller 62 sends the change amount of the linear speed to the main controller 61 and image forming controller 50. The main controller 61 and image forming controller 50 determine a new linear speed by giving consideration to the change amount in the current linear speed. After that, sheets P are conveyed in conformity to the linear speed having been determined. However, if the sheets F are conveyed at a new linear speed on a continuous basis, productivity may be reduced. To prevent this, it is preferred to use the new linear speed in the control only for a short period of time when tray shift operation is performed by the middle sheet discharging tray 41, for example.

The tray controller 62 determines a new sensor position by giving consideration to the change amount of sensor position in the current position of the sheet detection sensor 63. The tray controller 62 moves the sheet detection sensor 63 to the new sensor position having been determined. In this case, the sheet detection sensor 63 is moved without exceeding the alignment deviation limit value to ensure that the sheet detection sensor 63 will not move outside over the alignment deviation limit value.

In Step 20 (S20), the tray controller 62 determines if the entire printing work contained in the printing job has been completed or not. If the decision of Step 20 is affirmative, namely, if the entire printing work has been completed, this routine is exited. If the decision of Step 20 is negative, namely, if the entire printing work has not been completed, the operation goes back to the previous Step 13.

In Step 21 (S21) following the affirmative decision in Step 16, the tray controller 62 determines if the alignment performance priority mode as an operation mode has been selected or not. If the decision of Step 21 is affirmative, namely, if the alignment performance priority mode has been selected, the operation goes to Step 22 (S22). If the decision of Step 21 is negative, namely, if the productivity priority mode has been selected, the operation goes to Step 20.

In Step 22, the tray controller 62 sends a printing stop command to the main controller 61 and image forming controller 50, whereby the ongoing printing operation is suspended.

The operation of the sheet discharging tray device 40 is performed by a series of the aforementioned processing. If the printing operation has been suspended by the processing of Step 22 after execution of a printing job, the tray controller 62 allows the printing conditions and alignment deviation level to be stored in the RAM as data, which is reflected in the subsequent operations. To put it more specifically, when a printing job is to be executed under the same printing conditions, the tray controller 62 sets the fray shift amount to a value smaller than the default value in Step 11. For example, as shown in FIG. 8, the tray controller 62 retains the Table representing the correspondence between the alignment deviation level and tray shift amount, and the tray shift amount is set in conformity to the alignment deviation level, for example. The tray shift amount is set at a smaller value as the alignment deviation level is greater.

In the aforementioned present embodiment, the tray controller 62 changes the operation status of the middle sheet discharging tray 41 during the tray shift operation, based on the result of detection by the sheet detection sensor 63 for detecting the alignment deviation of the sheets in the tray shift direction. The tray controller 62 further changes the sheet discharge status for the sheets P to be discharged to the middle sheet discharging tray 41.

The inertia or air produced by the tray shift operation may cause the alignment deviation of sheets P. In the present embodiment, the tray shift operation of the middle sheet discharging tray 41 is performed in the operation status wherein alignment performance can be ensured by checking the current status of the alignment performance. Further, the sheet discharge status of the sheets P discharged into the middle sheet discharging tray 41 can be adjusted in conformity to the aforementioned tray shift operation. Thus, a desired alignment performance is ensured by optimization of the tray shift operation, and the maximum productivity is provided by optimization of the sheet discharge status of sheets P.

In the present embodiment, when the alignment deviation of the sheets P has been detected by the sheet detection sensor 63, the tray controller 62 changes the operation status of the middle sheet discharging fray 41 so as to reduce the movement of the middle sheet discharging tray 41. Further, the tray controller 62 changes the sheet discharge status of sheets P so as to increase the distance between discharged sheets discharged to the middle sheet discharging tray 41.

According to the aforementioned structure, the alignment deviation resulting from tray shift operation can be suppressed by reducing the movement of the middle sheet discharging tray 41, with the result that a desired alignment performance is ensured. Further, the distance between adjoining discharged sheets is provided with a margin by increasing the distance between sheets P discharged to the middle sheet discharging tray 41. This prevents sheets P from being discharged during the operation of the middle sheet discharging tray 41. Further, the maximum productivity is ensured by appropriate adjustment of the sheet discharge status.

In the present embodiment, the tray controller 62 calculates the alignment deviation level. To be more specific, the tray controller 62 evaluates the size of alignment deviation in sheets P on a stepwise basis, with reference to the alignment deviation limit value. In conformity to the alignment deviation level, the tray controller 62 changes the operation status of the middle sheet discharging tray 41 on a stepwise basis, and changes the sheet discharge status of the aforementioned sheets on a stepwise basis.

According to the aforementioned structure, a desired alignment performance is ensured by optimization of the tray shift operation, and the maximum productivity is provided by optimization of the sheet discharge status of sheets P.

In the present embodiment, the tray controller 62 suspends the operation of the apparatus when an alignment deviation of the sheets P in excess of the alignment deviation limit value has been detected.

According to the aforementioned structure, the alignment performance desired by the user can be provided.

In the present embodiment, the tray controller 62 allows the user to select whether the operation of the apparatus is to be suspended or not, when an alignment deviation of the sheets Pin excess of the alignment deviation limit value has been detected.

According to the aforementioned structure, the user is allowed to select an appropriate operation in conformity to the user's preference for each of the printing jobs of various possible patterns of alignment performance.

In the present embodiment, the tray controller 62 reduces the tray shift speed to change the operation status of the middle sheet discharging tray 41.

According to the aforementioned structure, a change is made to reduce the operation of the middle sheet discharging tray 41. This arrangement reduces the impact of the tray shift operation upon alignment performance, with the result that a desired alignment performance is achieved.

In the present embodiment, when alignment deviation has been detected on a primary basis, the tray shift speed is reduced. Without the present invention being restricted thereto, however, it is also possible to reduce the tray shift amount without changing the tray shift speed. Further, both the tray shift speed and tray shift amount can be changed.

In the present embodiment, the tray controller 62 reduces the linear speed of the sheets P along the conveyance path to change the sheet discharge status of sheets P.

According to the aforementioned structure, the linear speed of sheets P is reduced in conformity to reduction in the tray shift speed of the middle sheet discharging tray 41. This provides a margin in the distance between discharged sheets, and prevents sheets P from being discharged during the operation of the middle sheet discharging tray 41. Further, the maximum productivity is ensured by appropriate adjustment of the sheet discharge status.

In the present embodiment, the tray controller 62 ensures that the alignment deviation of the sheets P detected by the sheet detection sensor 63 is maintained as the data. When the printing conditions are used again to perform the same printing job, it is preferred that the operation status of the middle sheet discharging tray 41 should be changed in advance.

According to the aforementioned structure, the data is used as historical information in such a way that occurrence of an alignment deviation is presumed, and the middle sheet discharging tray 41 is operated to minimize such an alignment deviation.

In the present embodiment, the sheet detection sensor 63 is a transmission type sensor composed of a light emitting element 63*a* and light receiving element 63*b* set apart from each other in the sheet loaded direction. The tray controller 62 changes the position in the tray shift direction SD in conformity to the alignment performance of the sheets P.

According to the aforementioned structure, high-precision detection of alignment deviation of sheets P is ensured.

Figure 9A:
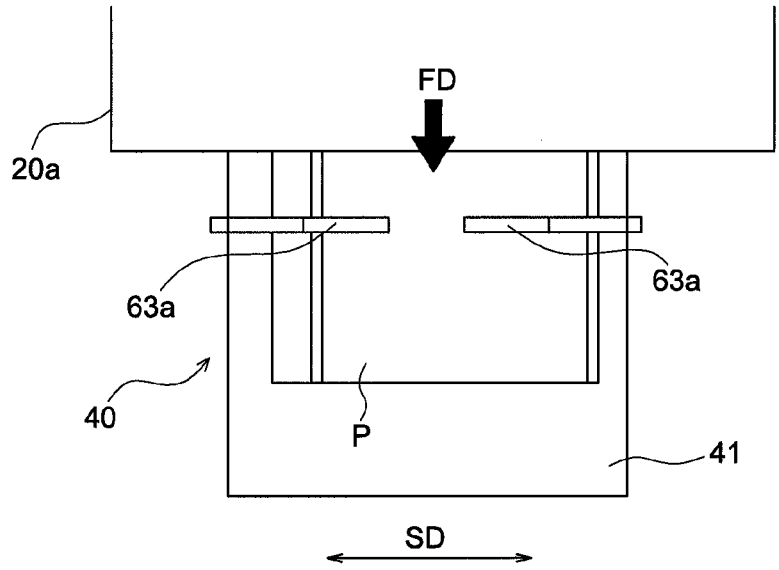
FIGS. 9A-9B are explanatory diagrams showing a second embodiment of the sheet detection sensor.
Figure 9B:
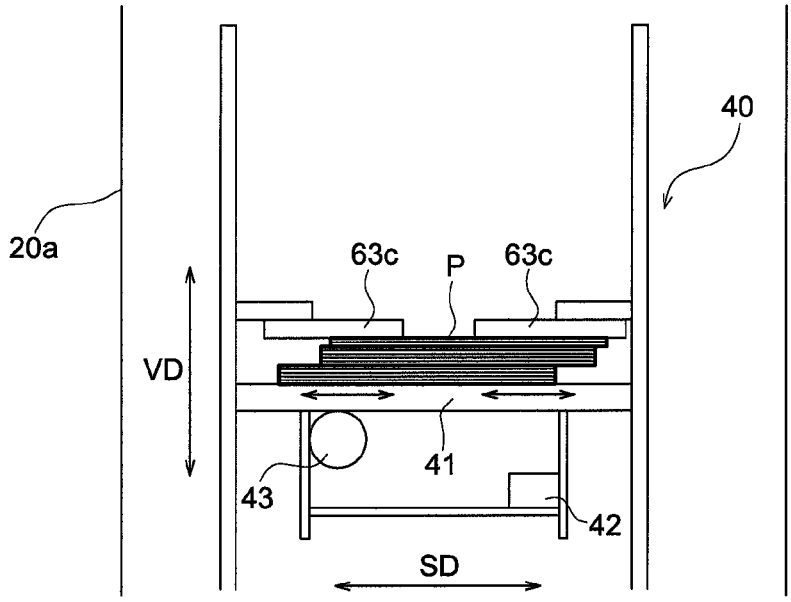

In the present embodiment, a transmission type sensor is employed as the sheet detection sensor 63. However, a linear image sensor (e.g., CCD line sensor) 63*c* with a plurality of light receiving elements (pixels) arranged linearly in the tray shift direction SD can be used as the sheet detection sensor 63, as shown in FIGS. 9A-9B. This arrangement ensures high-precision detection of the alignment deviation of sheets P and enhances alignment performance. When a sensor is used, it is preferred to design a structure that does not disturb the loading of sheets P. For example, resetting to a prescribed position is performed only when alignment performance of sheets P is detected.

Embodiment 2

The following describes the image forming system in the second embodiment of the present invention. The difference between the image forming system of the second embodiment and that of the first embodiment is found in the operation of the sheet discharging tray device 40 when an alignment deviation has been detected. The following mainly describes the difference. The description of the same structure as that of the first embodiment will be omitted to avoid duplication.

When an alignment deviation has been detected, the tray controller 62 changes the sheet discharge status of sheets P so that the distance between adjoining discharged sheets P will be increased as a result of change in the operation status of the middle sheet discharging tray 41. In the present embodiment, the tray controller 62 changes the distance between feeding sheets (i.e., PPM (Prints Per Minute)) per sheet as the sheet discharge status of sheets P. To put it more specifically, the tray controller 62 determines the change amount in such a way that the distance between sheets will be reduced per sheet, with the linear speed of sheets P kept unchanged. As shown in FIG. 10, the tray controller 62 retains the Table representing the correspondence between the alignment deviation level and the change amount of the distance between sheets per sheet. Referring to this Table, the tray controller 62 determines the change amount of the distance between sheets per sheet, based on the alignment deviation level.

As described above, in the present embodiment, to change the sheet discharge status of sheets P, the tray controller 62 reduces the distance between sheets per sheet, with the linear speed of sheets P along the conveyance path kept unchanged.

The linear speed of sheets P is reduced in conformity to the reduction in the tray shift speed of the middle sheet discharging tray 41. According to this structure, the distance between discharged sheets is provide with a margin, and this prevents sheets P from being discharged during the operation of the middle sheet discharging tray 41. Further, the maximum productivity is ensured by appropriate adjustment of the sheet discharge status.

Embodiment 3

Figure 11:
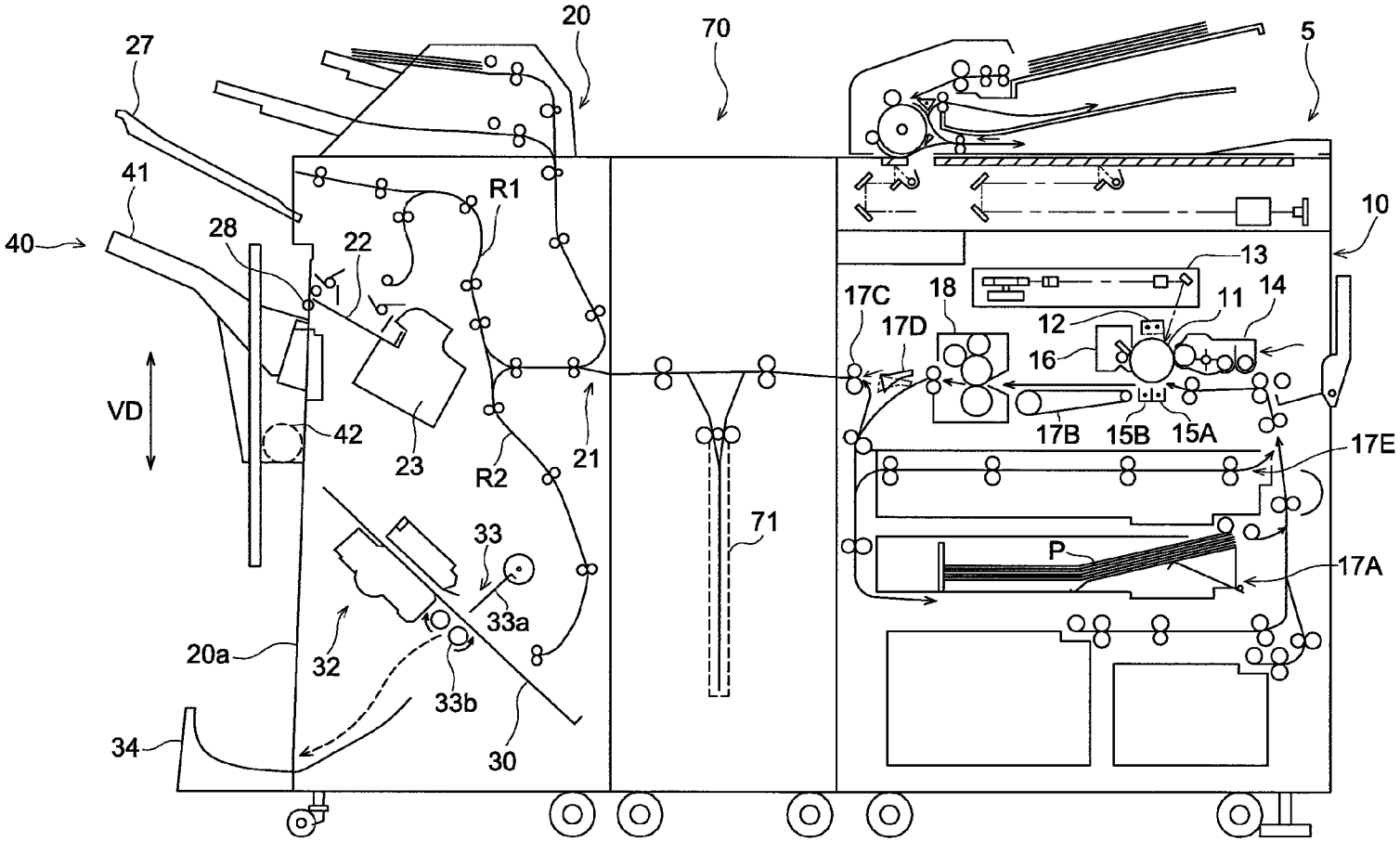
FIG. 11 is an explanatory diagram schematically representing the entire structure of an image forming system to which the sheet discharging tray device 40 of a third embodiment is applied.

FIG. 11 is a schematic diagram schematically representing the entire structure of an image forming system to which the sheet discharging tray device of a third embodiment is applied. The difference between the image forming system of the third embodiment and that of the first embodiment is found in that an intermediate conveyance device 70 is provided between the image forming apparatus 10 and sheet finisher 20. The following mainly describes the difference. The description of the same structure as that of the first embodiment will be omitted to avoid duplication.

The major components of the intermediate conveyance device 70 include a superimposing section 71 and an intermediate conveyance controller (not illustrated).

The superimposing section 71 is structured in such a way that a plurality of sheets P conveyed from the image forming apparatus 10 are stacked one on top of another, and are conveyed to the sheet finisher 20 in one operation. To be more specific, these sheets P are placed one on top of another by the superimposing section 71 so that the distance between sheets P to be supplied to the sheet finisher 20 is adjusted. This results in adjustment of the distance between discharged sheets of sheets P discharged to the middle sheet discharging tray 41.

The superimposing section 71 is capable of a regular conveying operation of conveying sheets one by one, and a superimposed conveying operation of conveying a plurality of sheets (e.g., two sheets) placed one on top of another. In the regular conveying operation mode, the sheets P fed out of the image forming apparatus 10 are sequentially conveyed along the conveyance path for conveying sheets to the sheet finisher 20. The superimposing section 71 is provided with a buffer roller along the conveyance path. When a plurality of sheets are conveyed one on top of another, the preceding sheet is fed to the buffer roller instead of the regular conveyance path, and the buffer roller is rotated. This allows the sheet P to be wound around the buffer roller. The succeeding sheet P is fed to the regular conveyance path. When this sheet has reached the position wherein the preceding sheet P and succeeding sheet P are to be placed one on top of the other, the buffer roller is rotated, and the preceding sheet P is conveyed on the succeeding sheet P so that the preceding sheet P and succeeding sheet P are to be placed one on top of the other. The two preceding and succeeding sheets placed one on top of the other are conveyed to the sheet finisher 20 along the conveyance path. The superimposing section 71 retains the preceding sheet P temporarily and places this sheet on top of the preceding sheet P. Then the conveyance of the sheets P is resumed.

In conformity to the control signal coming from the image forming controller 50 or sheet finisher controller 60 (tray controller 62), the intermediate conveyance controller controls the operation of conveying the sheets including the sheets placed one on top of another.

Based on the aforementioned system configuration, the following describes the operations of the sheet discharging tray device 40 when an alignment deviation has been detected. When an alignment deviation has been detected, the tray controller 62 changes the sheet discharge status of the sheet P so that the distance between adjoining discharged sheets P will be increased in conformity to a change in the operation status of the middle sheet discharging tray 41. In the present embodiment, the tray controller 62 instructs the conveying operation wherein sheets P should be placed one on top of another and should be conveyed to the intermediate conveyance device 70. Thus, in the process of sheets P reaching the sheet discharging roller 28, the tray controller 62 retains the preceding sheet P temporarily and allows the succeeding sheet P to be placed on top of the preceding sheet P. After that, conveyance of sheets P is resumed.

In the present embodiment, in the process of sheets P reaching the sheet discharging roller 28, the tray controller 62 retains the preceding sheet P temporarily and allows the succeeding sheet P to be placed on top of the preceding sheet P. After that, the sheets P are conveyed again.

The linear speed of sheets P is reduced in conformity to the reduction in the tray shift speed of the middle sheet discharging tray 41. According to this structure, the distance between discharged sheets is provided with a margin, and this prevents sheets P from being discharged during the operation of the middle sheet discharging tray 41. Further, the maximum productivity is ensured by appropriate adjustment of the sheet discharge status.

The intermediate conveyance device 70 need not always be used to place sheets P one on top of another and to discharge the same from the sheet discharging roller 28 to the middle sheet fray 41. For example, it is also possible to arrange such a configuration that a plurality of sheets P are placed on the first intermediate stacker 22 of the sheet finisher 20, and are pushed toward the sheet discharging roller 28 by an extrusion member (not illustrated). After that, these sheets are discharged to the middle sheet discharging tray 41 by the sheet discharging roller 28.

A sheet finisher, control method thereof and image forming system in the embodiments of the present invention have been described. It goes without saying that the present invention is not restricted thereto. The present invention can be embodied in a great number of variations with appropriate modifications or additions, without departing from the technological spirit and scope of the invention claimed. For example, the sheet discharging tray device is applicable not only to the middle sheet discharging fray but also to the upper sheet discharging tray or lower sheet discharging tray. Further, this sheet discharging tray device is applicable not only to a sheet finisher but also to the sheet discharging tray device of an image forming apparatus. Further, the distance between discharged sheets P can be changed by using a combination of the methods shown for each of the first through third embodiments. Further, the present embodiment has been described using an example of applying the sheet discharging tray device to the image forming system. The sheet discharging tray device itself serves as part of the present invention.

According to the present embodiments, the tray shift operation of the sheet discharging tray is performed in the operation status wherein alignment performance can be ensured by checking the current status of the alignment performance. The sheet discharge status of the sheets discharged into the middle sheet discharging tray can be adjusted in conformity to the aforementioned tray shift operation. Thus, a desired alignment performance is ensured by optimization of the tray shift operation, and the maximum productivity is provided by optimization of the sheet discharge status of sheets.

What is claimed is:

1. A sheet discharging tray device comprising:

(a) a discharging section from which a sheet is discharged;

(b) a discharging tray on which the sheet discharged from the discharging section is stacked sequentially;

(c) a tray drive section which drives the discharging tray in a tray shift direction that is perpendicular to a sheet discharging direction from the discharging section with reference to a sheet surface;

(d) a controller which conducts a tray shift operation that shifts a position of the discharging tray under a condition of the number of sheets stacked on the discharging tray; and (e) a sheet detection section which detects an alignment deviation in the tray shift direction, wherein the controller changes an operation status of the discharging tray when a tray shift operation is conducted and changes a discharging operation of the sheet to the discharging tray, based on a detected result of the sheet detection section; and when an alignment deviation of the sheets is detected by the sheet detection section, the controller changes the operation status of the discharging tray so that movement of the discharging tray is reduced, and changes the discharging status so that a distance between adjoining sheets discharged to the discharging tray is increased.

2. The sheet discharging tray device of claim 1, wherein the controller makes a stepwise evaluation of a magnitude of the alignment deviation of the sheet with reference to a limit value of an alignment deviation that is acceptable to a user, changes in a stepwise fashion the operation status of the discharging tray, and changes in a stepwise fashion the sheet discharging status according to a level of the evaluation.

3. The sheet discharging tray device of claim 2, wherein when an alignment deviation of the sheet exceeding the limit value is detected, the controller stops the operation of the sheet discharging tray device.

4. The sheet discharging tray device of claim 2, wherein when an alignment deviation of the sheet exceeding the limit value is detected, the controller allows a user to select whether the operation of the sheet discharging tray device is stopped or continued.

5. The sheet discharging tray device of claim 1, wherein the controller conducts at least one of a method in which the moving amount of the discharging tray is reduced, and a method in which the moving speed of the discharging tray is reduced, out of methods that change the operation status of the discharging tray.

6. The sheet discharging tray device of claim 1, further comprising a conveyance path including the discharging section, through which the sheet is conveyed to the discharging section, wherein the controller conducts at least one of a method in which the moving speed of the sheet in the conveyance path is lowered, a method in which a distance between adjoining sheets per one sheet is lowered while the moving speed of the sheet in the conveyance path is maintained, and a method in which after a preceding sheet is suspended temporarily and a succeeding sheet is superimposed on the preceding sheet during a conveying process of the sheets to the discharging section, the conveying process is restarted, out of methods that change the discharging status of the sheet.

7. The sheet discharging tray device of claim 1, wherein when the controller holds the alignment deviation of the sheet detected by the sheet detection section as data, and when a printing job having a same printing condition is executed again, the controller changes in advance the operation status of the discharging tray.

8. The sheet discharging tray device of claim 1, wherein the sheet detection section is a transmission type sensor composed of a light emission element and a light receiving element that are faced and separated from each other in a sheet stacking direction, and wherein the controller changes a position of the transmission type sensor in the tray shift direction according to a sheet alignment performance.

9. The sheet discharging tray device of claim 1, wherein the sheet detection section is a linear image sensor in which a plurality of image receiving elements are arranged linearly in the tray shift direction.

10. A image forming system comprising:

(a) a sheet discharging tray device comprising:

(1) a discharging section from which a sheet is discharged, (2) a discharging tray on which the sheet discharged from the discharging section is stacked sequentially, (3) a tray drive section which drives the discharging tray in a tray shift direction that is perpendicular to a sheet discharging direction from the discharging section with reference to a sheet surface, (4) a controller which conducts a tray shift operation that shifts a position of the discharging tray under a condition of the number of sheets stacked on the discharging tray, and (5) a sheet detection section which detects an alignment deviation in the tray shift direction, wherein the controller changes an operation status of the discharging tray when a tray shift operation is conducted and changes a discharging operation of a sheet to the discharging tray, based on a detected result of the sheet detection section; and (b) an image forming apparatus which forms an image on the sheet wherein when an alignment deviation of the sheets is detected by the sheet detection section, the controller changes the operation status of the discharging tray so that movement of the discharging tray is reduced, and changes the discharging status so that a distance between adjoining sheets discharged to the discharging tray is increased.

11. The image forming system of claim 10, wherein the controller makes a stepwise evaluation of a magnitude of the alignment deviation of the sheet with reference to a limit value of an alignment deviation that is acceptable to a user, changes in a stepwise fashion the operation status of the discharging tray, and changes in a stepwise fashion the sheet discharging status according to a level of the evaluation.

12. The image forming system of claim 11, wherein when an alignment deviation of the sheet exceeding the limit value is detected, the controller stops the operation of the sheet discharging tray device.

13. The image forming system of claim 11, wherein when an alignment deviation of the sheet exceeding the limit value is detected, the controller allows a user to select whether the operation of the sheet discharging tray device is stopped or continued.

14. An image forming system comprising:

(a) a sheet discharging tray device comprising:

(1) a discharging section from which a sheet is discharged, (2) a discharging tray on which the sheet discharged from the discharging section is stacked sequentially, (3) a tray drive section which drives the discharging tray in a tray shift direction that is perpendicular to a sheet discharging direction from the discharging section with reference to a sheet surface, (4) a controller which conducts a tray shift operation that shifts a position of the discharging tray under a condition of the number of sheets stacked on the discharging tray, and (5) a sheet detection section which detects an alignment deviation in the tray shift direction, wherein the controller changes an operation status of the discharging tray when a tray shift operation is conducted and changes a discharging operation of a sheet to the discharging tray, based on a detected result of the sheet detection section;

(b) an image forming apparatus which forms an image on the sheet; and (c) a sheet finisher which conducts a post processing onto the sheet on which the image has been formed by the image forming apparatus;

wherein when an alignment deviation of the sheets is detected by the sheet detection section, the controller changes the operation status of the discharging tray so that movement of the discharging tray is reduced, and changes the discharging status so that a distance between adjoining sheets discharged to the discharging tray is increased.

15. The image forming system of claim 14, wherein the controller makes a stepwise evaluation of a magnitude of the alignment deviation of the sheet with reference to a limit value of an alignment deviation that is acceptable to a user, changes in a stepwise fashion the operation status of the discharging tray, and changes in a stepwise fashion the sheet discharging status according to a level of the evaluation.

16. The image forming system of claim 15, wherein when an alignment deviation of the sheet exceeding the limit value is detected, the controller stops the operation of the sheet discharging tray device.

17. The image forming system of claim 14, further comprising an intermediate conveyance device having an superimposing section, which conveys the sheet conveyed from the image forming apparatus to the sheet finisher in a state in which a plurality of sheets conveyed from the image forming apparatus are superimposed.

* * * * *